US009540081B2

(12) United States Patent
Giannatos

(10) Patent No.: US 9,540,081 B2
(45) Date of Patent: Jan. 10, 2017

(54) ICE SKATEBOARD

(76) Inventor: Kalliopi Giannatos, New York, NY (US)

( * ) Notice: Subject to any disclaimer, the term of this patent is extended or adjusted under 35 U.S.C. 154(b) by 42 days.

(21) Appl. No.: 13/374,035

(22) Filed: Dec. 8, 2011

(65) Prior Publication Data

US 2012/0146300 A1 Jun. 14, 2012

Related U.S. Application Data

(62) Division of application No. 12/214,331, filed on Jun. 18, 2008, now Pat. No. 8,091,902.

(51) Int. Cl.
*B63B 59/02* (2006.01)
*A63C 17/01* (2006.01)

(52) U.S. Cl.
CPC ..... *B63B 59/02* (2013.01); *A63C 17/018* (2013.01)

(58) Field of Classification Search
CPC ..... A63C 17/01; A63C 17/18; A63C 17/018; A63C 17/06; A63C 10/18; A63C 17/22; A63C 17/267; A63C 2203/42
See application file for complete search history.

(56) References Cited

U.S. PATENT DOCUMENTS

| | | | | | |
|---|---|---|---|---|---|
| 2,266,842 | A * | 12/1941 | Angell | 280/21.1 |
| 3,120,397 | A * | 2/1964 | Zwahlen et al. | 280/11.12 |
| 3,415,528 | A * | 12/1968 | Herold | 280/11.12 |
| 3,628,804 | A * | 12/1971 | Carreiro | 280/18 |
| 3,993,318 | A * | 11/1976 | Rothmayer | 280/11.26 |
| 4,773,658 | A * | 9/1988 | Bourque et al. | 280/11.12 |
| 5,409,265 | A * | 4/1995 | Douglass | 280/843 |
| 6,203,028 | B1 * | 3/2001 | Kress | 280/11.12 |
| 7,688,323 | B2 * | 3/2010 | Ferguson et al. | 345/473 |
| 7,699,323 | B2 * | 4/2010 | Taylor | 280/14.21 |
| 2001/0005069 | A1 * | 6/2001 | Soo | 280/7.12 |
| 2004/0036257 | A1 * | 2/2004 | Lille et al. | 280/604 |
| 2007/0001426 | A1 * | 1/2007 | Wade | 280/608 |
| 2007/0096433 | A1 * | 5/2007 | Musselman | 280/608 |
| 2010/0314844 | A1 * | 12/2010 | Spah | 280/11.18 |

* cited by examiner

*Primary Examiner* — John Walters
*Assistant Examiner* — James Triggs
(74) *Attorney, Agent, or Firm* — Hedman & Costigan, P.C.; James V. Costigan; Kathleen A. Costigan

(57) ABSTRACT

An ice skateboard comprising a skateboard having a top surface, a bottom surface, side edges, and a front and back section, said ice skateboard having an ice blade assembly attached to the bottom surface, said ice blade assembly comprising a mounting plate having at least one integral ice blade that extends outwardly at substantially right angles from said mounting plate.

5 Claims, 9 Drawing Sheets

ICE SKATEBOARD

This application is a divisional application of Ser. No. 12/214,331, filed Jun. 18, 2008 which is now U.S. Pat. No. 8,091,902.

FIELD OF THE INVENTION

The present invention relates generally to a skateboard having ice blades, and more particularly to a skateboard adapted for use on snow and ice.

BACKGROUND OF THE INVENTION

Skateboards with ice blades are well known. On such skateboards, the ice blades typically are either directly attached to the board of the skateboard or mounted on the truck axles of the truck assembly of the skateboard in replacement of the roller wheels.

An example of an ice skateboard is found in U.S. Pat. No. 4,896,893. Other ice skateboards are described in U.S. Pat. No. 6,311,990, U.S. Pat. No. 4,114,913 and U.S. Pat. No. 4,194,753.

For such ice skateboards, the rigidity of the connection of the ice blades to the skate board depends on the used of one or more brackets that separate attach the ice blades to the skate board. This may result in a high stress being applied to the mountings when unequal pressures are applied to an outer ice blade. These high stresses are all focused on the individual mounting brackets of a particular blade.

Accordingly, there is a need for an improved blade runner assembly for an ice skateboard that is made of an integral. unitary mounting bracket and ice blades that may be fastened as a single unit to a skateboard to form a highly durable and reliable ice skateboard.

SUMMARY OF THE INVENTION

The invention provides an ice skateboard comprising a skateboard having a top surface, a bottom surface, side edges, and a front and back section, said ice skateboard having an ice blade assembly attached to the bottom surface, said blade assembly comprising a mounting plate having at least one integral ice blades that extend outwardly at substantially right angles from said mounting plate. The ice skateboard is elongated and has a generally planar shape with said front and back sections are both curved upwardly from said top surface of said ice skateboard. An ice skateboard may have one, two or three ice blades.

A preferred embodiment comprises an ice skateboard having a third ice bade disposed between said first and second ice blades which is substantially parallel to said first and second ice blade.

The integral blade assembly provides a more robust ice skateboard construction which is resistant to damage due to extended use under adverse conditions.

Runner assembly is further advantageous in that it provides runner surfaces upon which body of runner may slide on a sliding surface even when the body is not in the neutral position.

BRIEF DESCRIPTION OF THE DRAWINGS

Further aspects and advantages of the present invention will become better understood with reference to the description in association with the following Figures, wherein.

DETAILED DESCRIPTION OF THE PREFERRED EMBODIMENTS

The preferred embodiments of the present invention will be described by reference to the drawings which are not intended to limit the scope of the invention.

Figure 1:
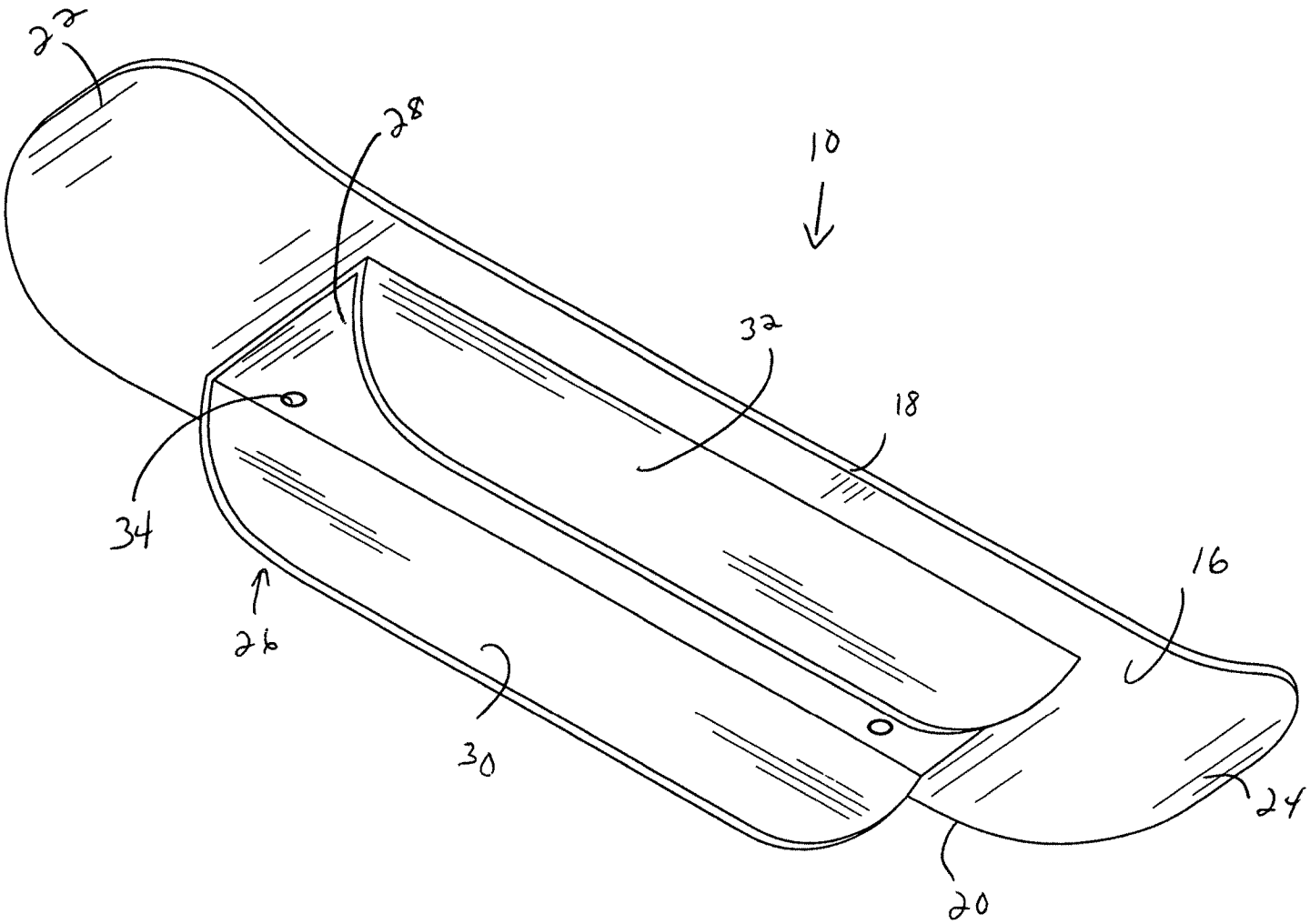
FIG. 1 is a bottom perspective view of the invention with two runners.

Referring to FIG. 1 there is shown an ice skateboard 10 having a bottom surface 16, edges 18 and 20 and a front section 22 and a back section 24. The ice skateboard has an ice blade assembly 26 attached to the bottom surface. The ice blade assembly 26 comprises a mounting plate 28 having at least two integral ice blades 30, 32 that extend outwardly at substantially right angles from said mounting plate 28 and are substantially parallel to each other and also substantially parallel to edges 18,20. The ice skateboard is elongated and has a generally planar shape with said front and back sections 22, 24 curved upwardly from said top surface of said ice skateboard. The length of the ice skate board should be about 3 to 6 times the width of the board. The ice blades should be from one half to three quarters of the length of the ice skate board. These dimensions are not critical and may be varied to obtain the riding properties that are most desired by the user.

The ice blade assembly 26 is provided with one or more holes 34 to provide a means for attaching the ice blades to the ice skate board by bolts or rivets (not shown). Alternatively, the ice blades can be attached to the ice skate board by using conventional adhesives. The use of integral ice blades which are formed by bending, casting or welding the blades to a mounting plate is a preferred method construction. This is because the integral structure avoids stresses which are concentrated in discrete areas when a blade is mounted on a board using short brackets. The mounting plate 28 is preferably of the same length as the ice blade or blades but it may be longer or shorter.

The ice skate board may be made of wood, steel, fiberglass laminates that are conventionally used to manufacture roller skating boards.

The ice blades are preferably made of metal such as steel that my be polished stainless steel or may be chromium plated steel to enhance the appearance of the ice skate board any provide corrosion resistance.

Figure 2:
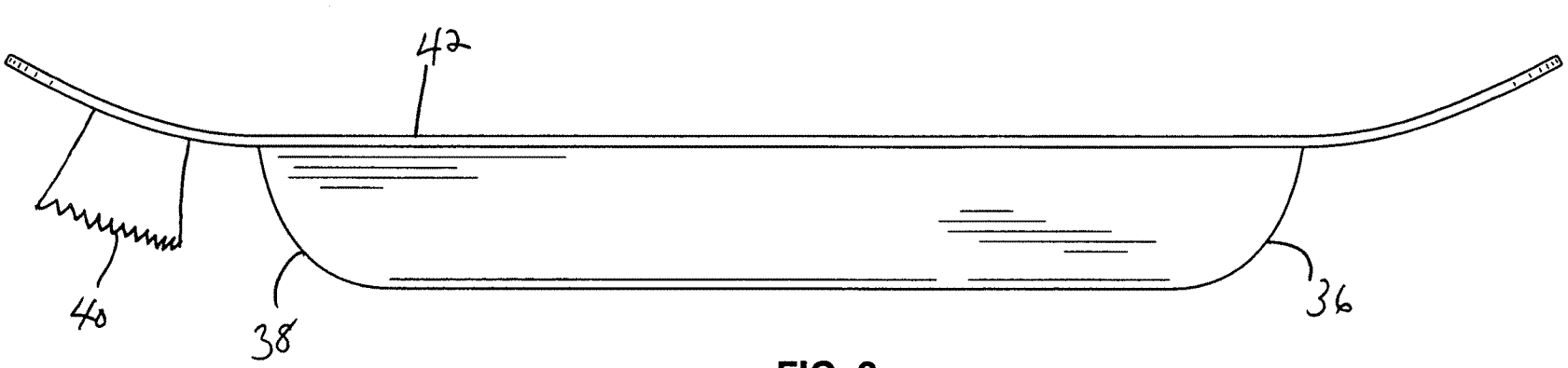
FIG. 2 is a right side view of the invention which is a mirror image of the left side view of the invention.

As shown in FIG. 2, the ice blades preferably have a curved front section 36 and a curved rear section 38. An optional stopping block 40 may be placed at the back section 24 to assist in slowing or stopping the user. The stopping block 40 is activated when the user applies pressure on the rear section 22 to cause the ice skate board to become elevated at the front so that pressure is applied on the stopping block 40 which cause the stopping block to contact the surface of the ice. The stopping block 40 may be made of metal, plastic or rubber and preferably has a roughened or toothed surface that engages the ice when the stopping block is activated.

Figure 3:
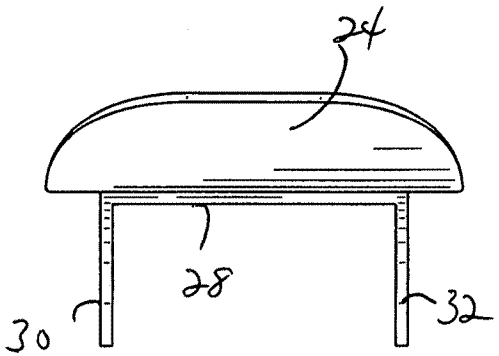
FIG. 3 is a front view of the invention which is a mirror image of the back view of the invention.
Figure 4:
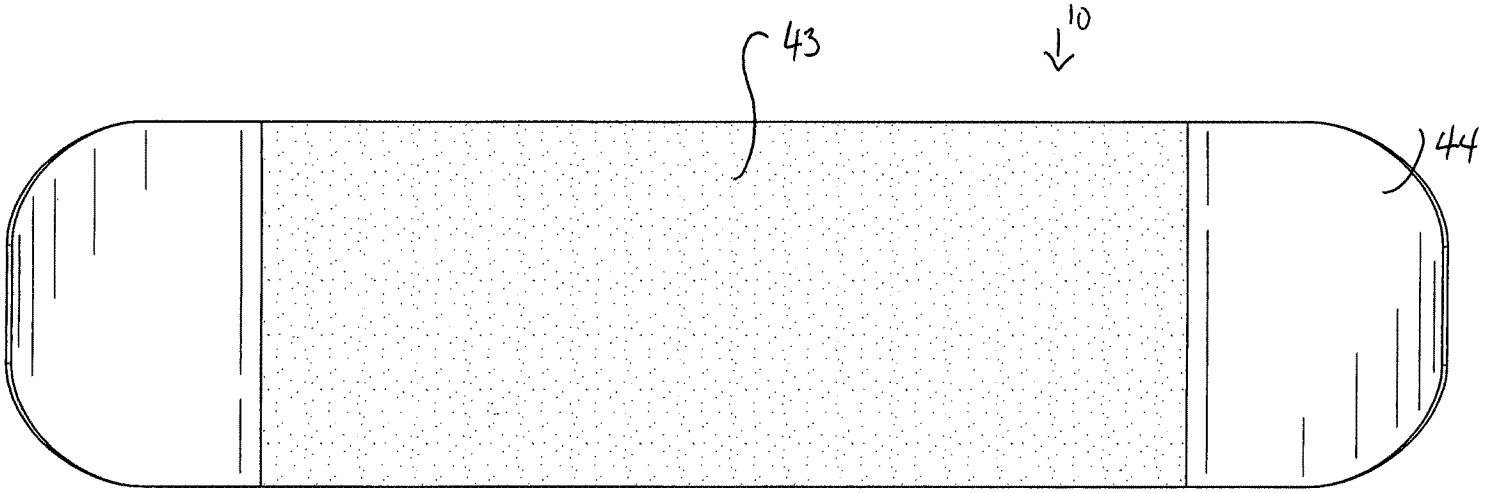
FIG. 4 is a top view of the invention.

FIG. 3 shows the end view of the ice skateboard where the end of plate 28 is shown in contact with the ice skate board. FIG. 4 is a top view of the ice skate board 10 where the top 44 is partially covered with a roughened surface 43 that is resistant to skidding when the user stands on the ice skate board and exerts pressure of the ice skate board to cause the ice skate board to turn or stop. The roughened surface may be ad adhesively mounted strip of sand paper having a suitable grit embedded therein using conventional techniques.

Figure 5:
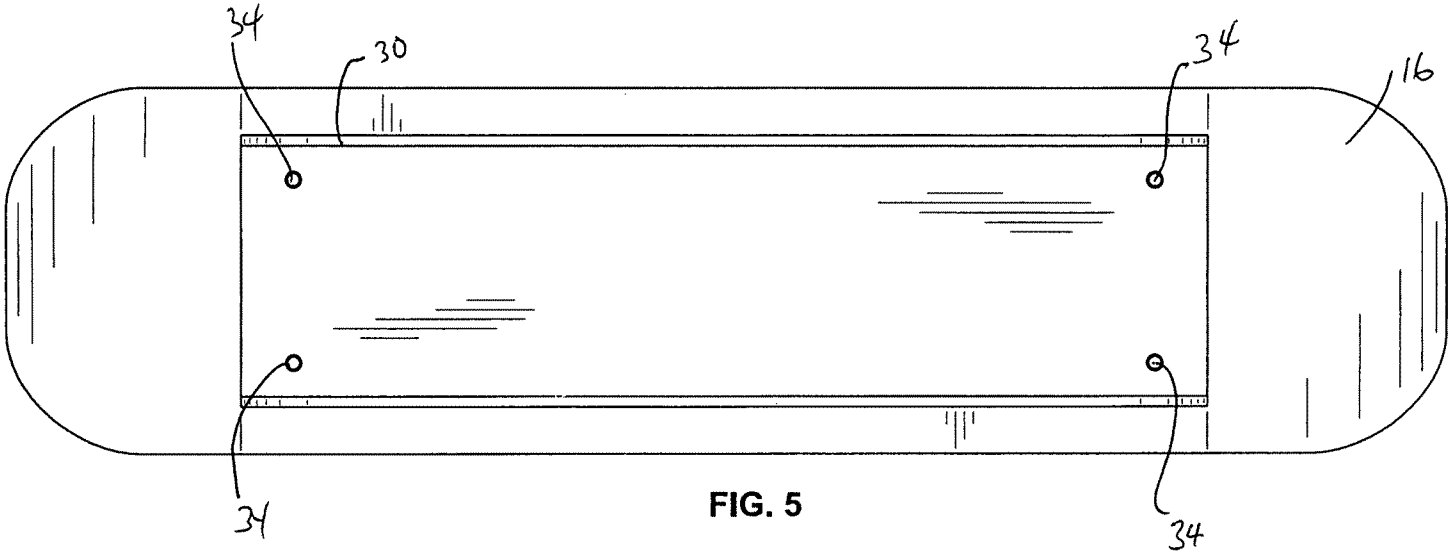
FIG. 5 is a bottom view of the invention.

FIG. 5 is a bottom view of the ice skateboard showing a two ice blades 30, 32 and a bottom view of the mounting plate 28. The holes 34 are positioned to attach the ice blade assembly to the ice skateboard 10 using four bolts or rivets.

Figure 6:
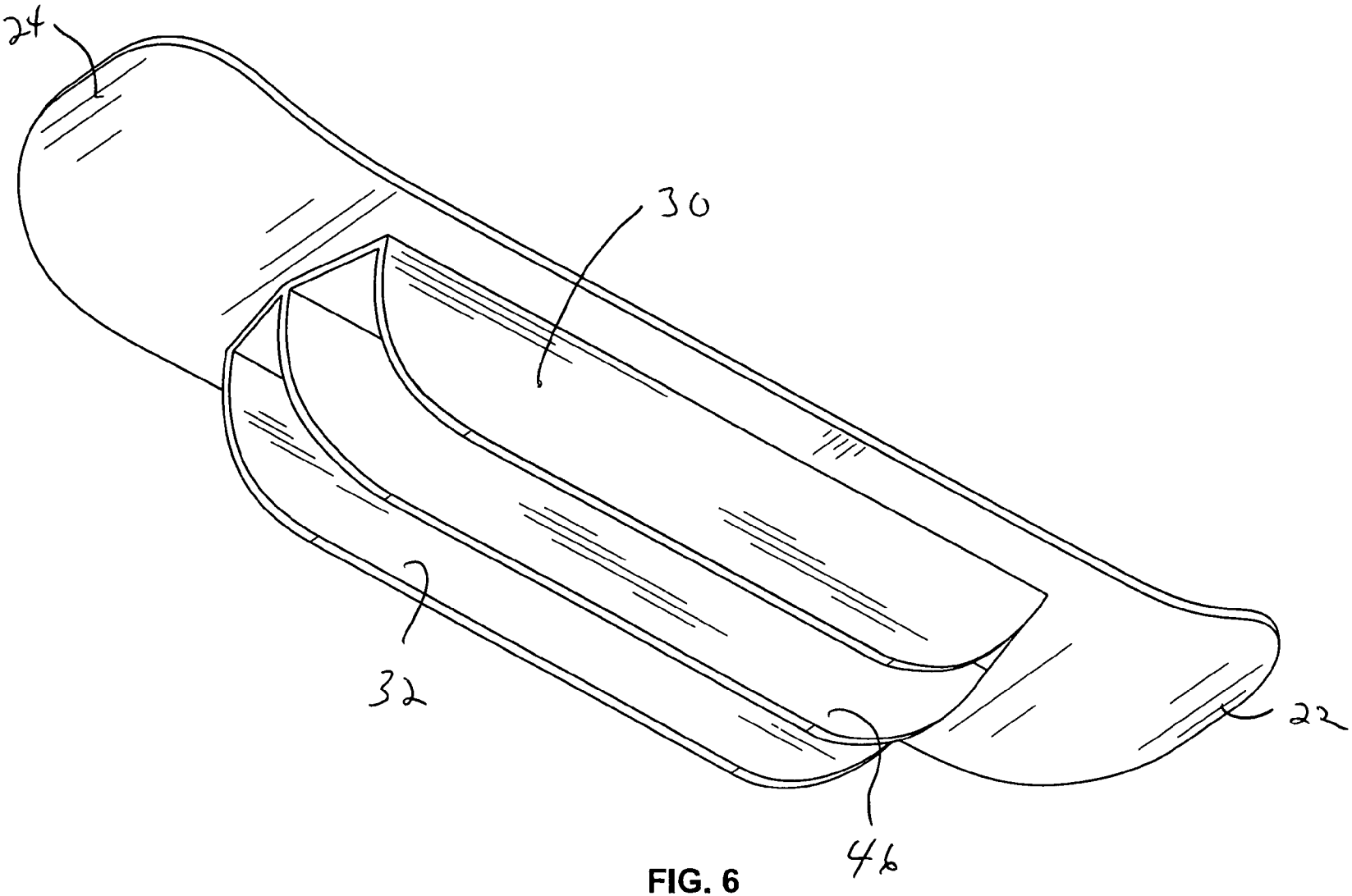
FIG. 6 is a bottom perspective view of the invention of an embodiment having three runners.
Figure 7:
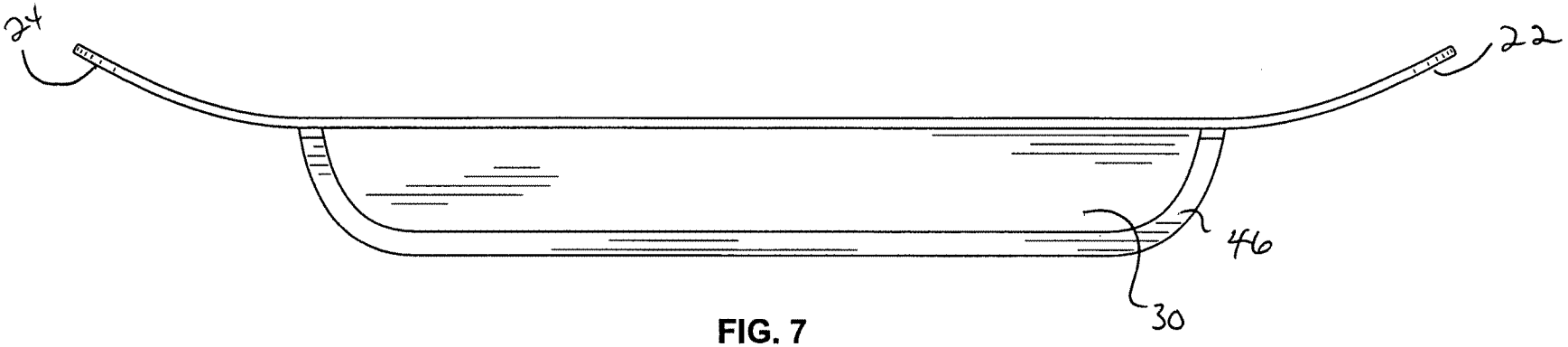
FIG. 7 is a right side view of the invention which is a mirror image of the left side view of the invention.
Figure 8:
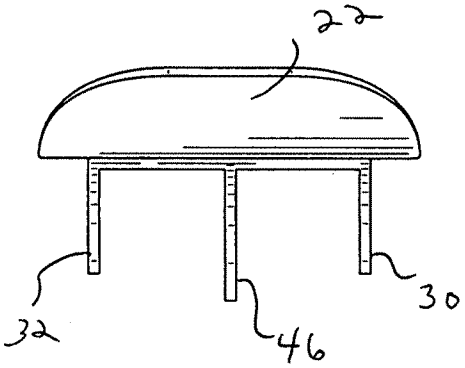
FIG. 8 is a front view of the invention which is a mirror image of the back view of the invention.

FIG. 6 is a bottom perspective view of an embodiment of the invention that has three ice blade. A first side blade 30 and a second side blade 32 are positioned adjacent edges 18 and 20. A third ice blade 46 is positioned approximately equal distances from the first side blade 30 and the second side blade 32 so that the three blades are substantially parallel to each other and to the edges 18, 20 of the ice skateboard. The third ice blade 46 is sized so that it extends further from the mounting plate 28 than side ice blades 30 and 32. This is illustrated in FIG. 8 where third ice blade 46 is extended from the mounting plate. The exact distance that third ice blade 46 extends from mounting plate 28 beyond the distance that ice blades 30 and 32 extend from mounting plate 28 is a distance that will permit optimal turning efficiency and speed, which will be increased when the user balances solely on the third ice blade 46. The distance that the ice blade extends from the mounting plate beyond the distance that the side blade extend will ordinarily be from one-sixteenth inch to one-half inch and preferably from one-eighth inch to one quarter inch. The typical length of the ice skateboard is preferably from 30 to 36 inches and the preferred width is from 7 to 8 inches.

Figure 9:
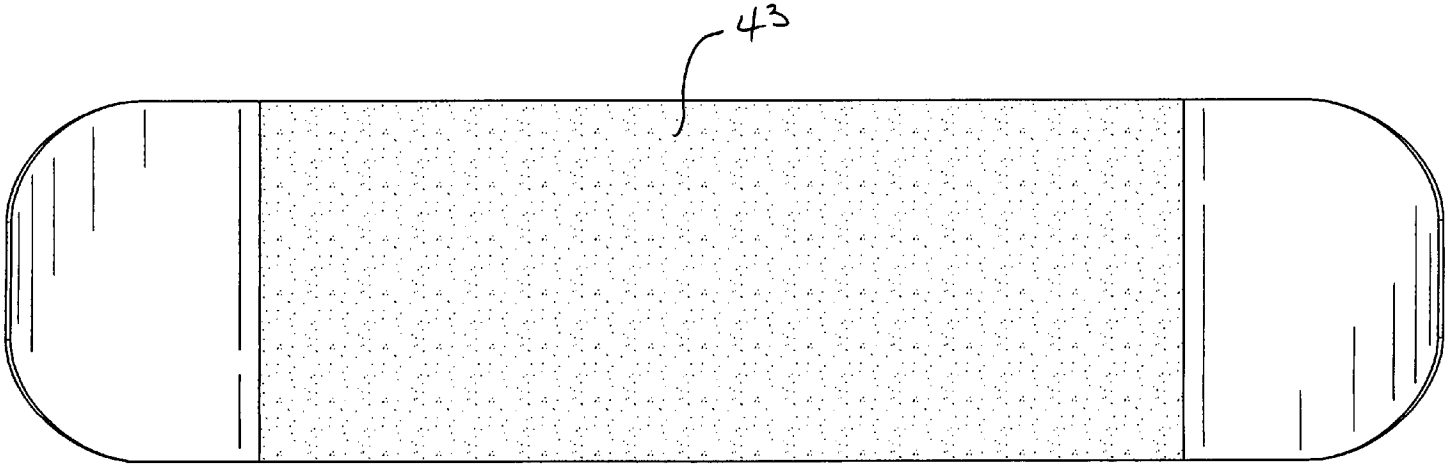
FIG. 9 is a top view of the invention.
Figure 10:
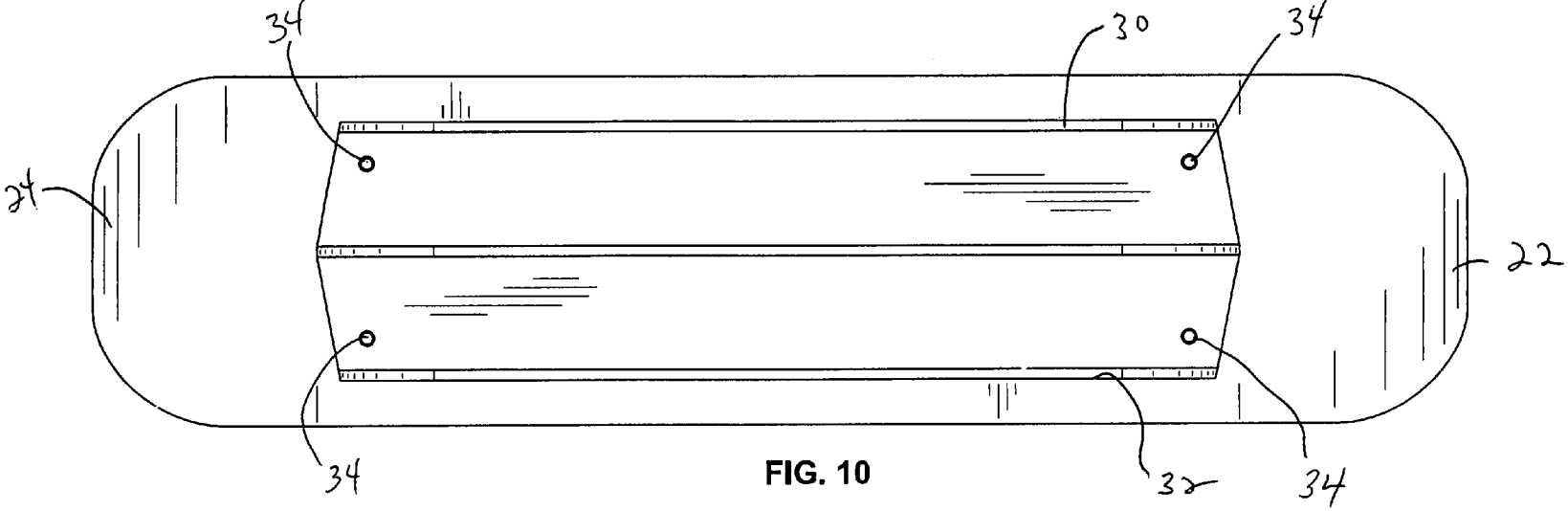
FIG. 10 is a bottom view of the invention.

FIG. 9 shows the top surface of a three blade ice skateboard with a roughened surface 43 which has been described above. FIG. 10 is a bottom view of an ice skateboard having three ice blades. The third ice blade 46 is shown as being longer than side ice blades 30 and 32. In addition, the edges of the three ice blades 30,32 and 46 are shown with a flat profile that is intended to contact the ice. The dimensions of the flat profile are those typically used for conventional shoe mounted ice skates.

Figure 11:
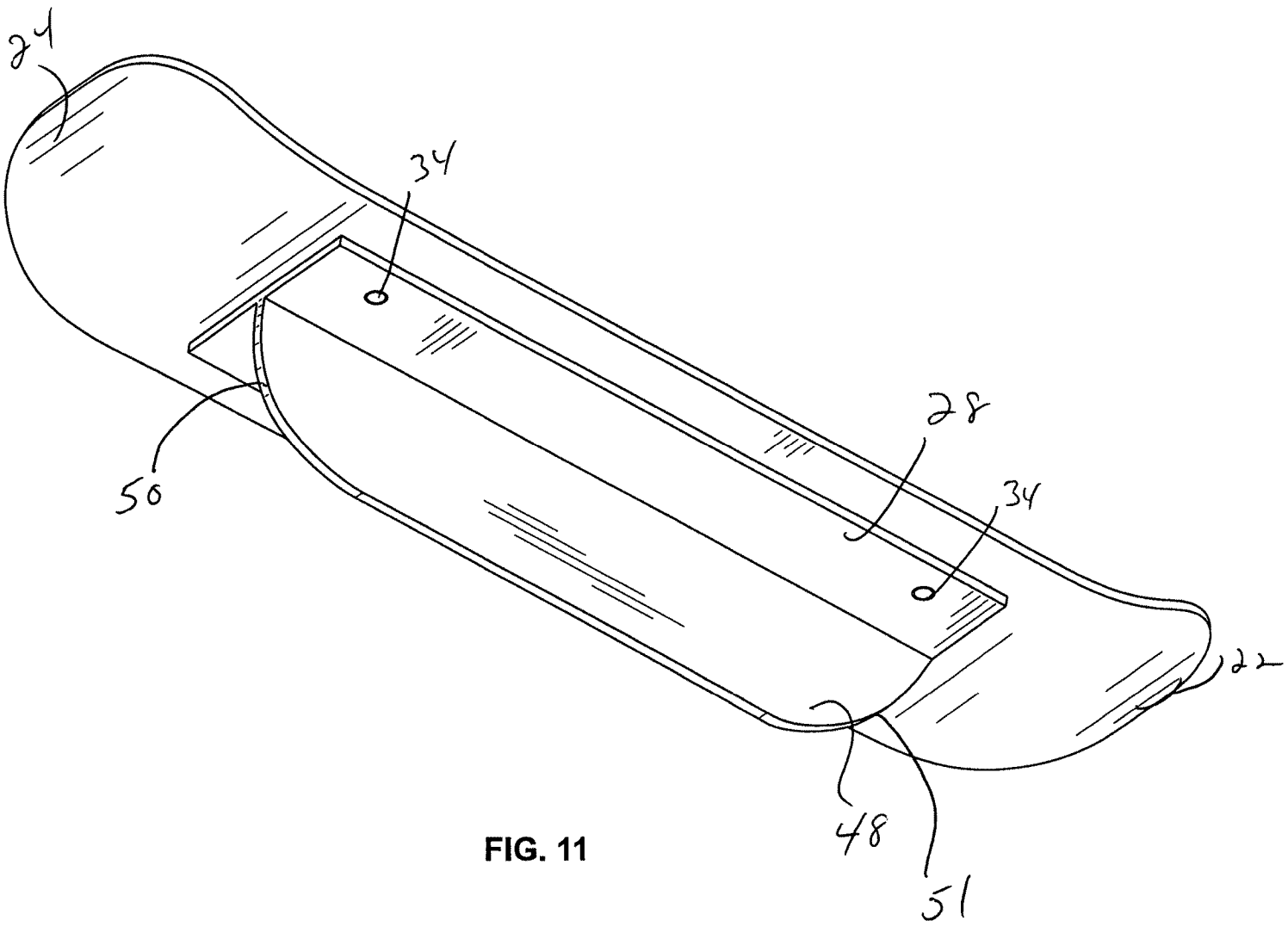
FIG. 11 is a bottom perspective view of an embodiment of the invention which has one runner.

FIG. 11 is a bottom perspective view of an embodiment of the invention which has a single ice blade 48 mounted on plate 28. The single blade is mounted substantially in the center of the ice skateboard and is has curved ends 50, 51.

Figure 12:
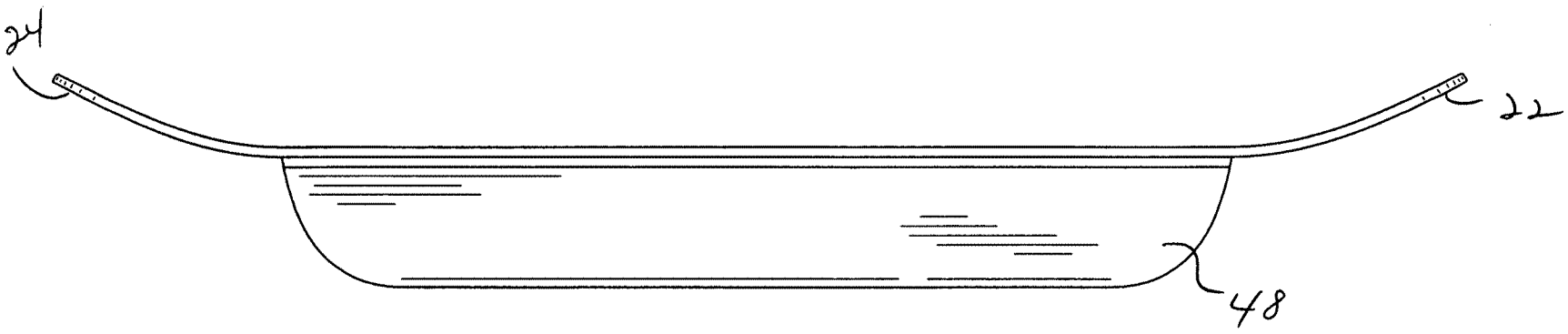
FIG. 12 is a side view of an ice skateboard having a single ice blade.
Figure 13:
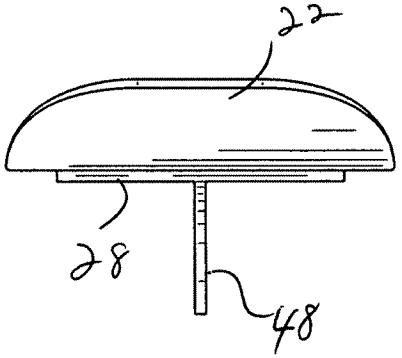
FIG. 13 is an end view of an ice skateboard having a single ice blade.

The ice blades, whether one, two or three preferably extend about one half to three quarters of the total length of the ice skateboard but any convenient length may be used FIG. 12 is a side view of an ice skateboard having a single ice blade 48 which is mounted approximately in the middle of the bottom of the ice skateboard. The single ice blade preferably has a curved front section and a curved rear section as shown in FIG. 12. FIG. 13 shows an end view of a single blade ice skateboard where single blade 48 is mounted on a mounting plate which is fastened to the ice skateboard.

Figure 14:
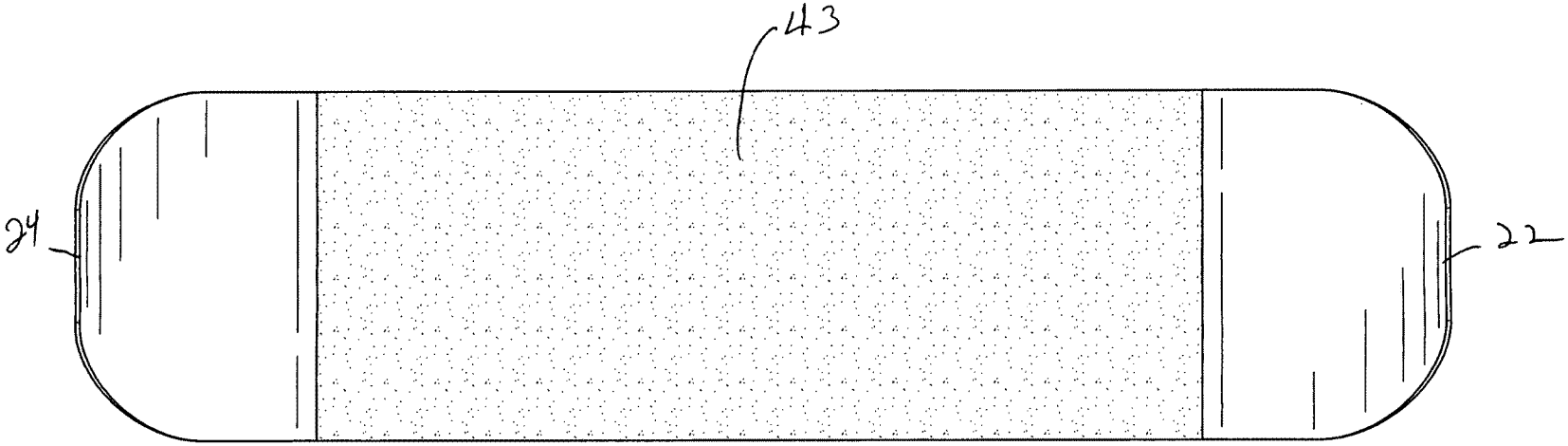
FIG. 14 is a top surface of a three blade ice skateboard.
Figure 15:
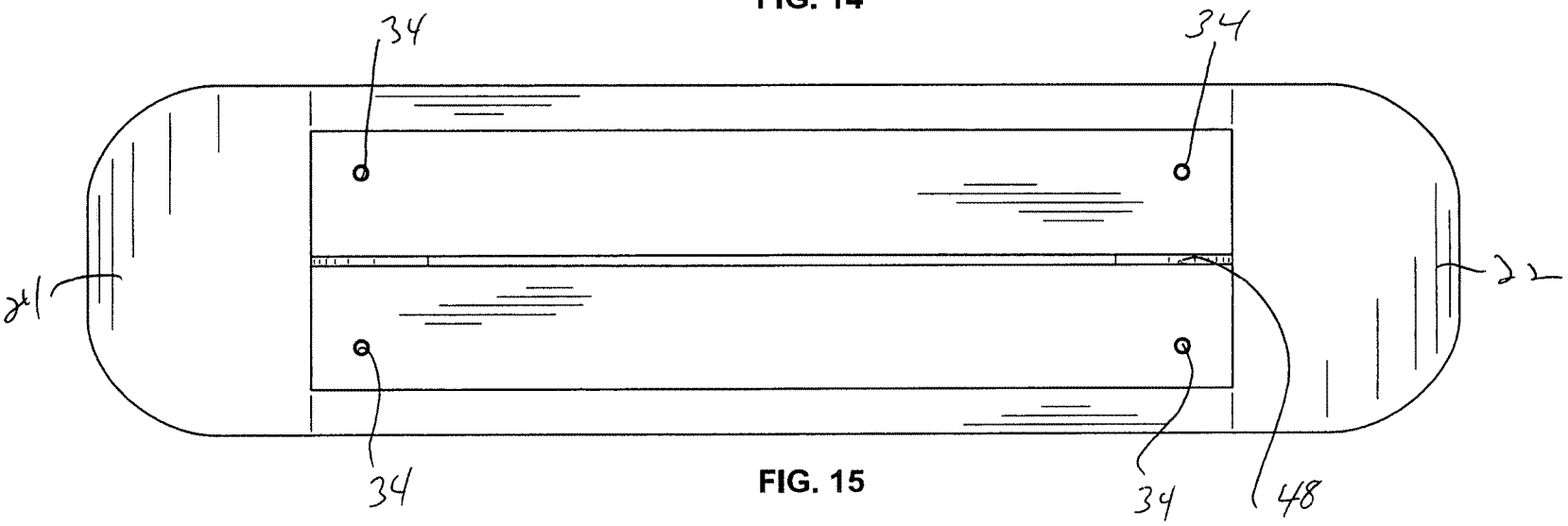
FIG. 15 is a bottom view of an ice skateboard having a single ice blade.

FIG. 14 shows the top surface of a three blade ice skateboard with a roughened surface 43 which has been described above. FIG. 15 is a bottom view of an ice skateboard having a single ice blade which is mounted on the ice skateboard using holes 34 and conventional bolts or rivets.

Although the present ice skateboard has been described with a certain degree of particularity, it is to be understood that the disclosure has been made by way of example only and that the present invention is not limited to the features of the embodiments described and illustrated herein, but includes all variations and modifications within the scope and spirit of the invention as hereinabove described.

I claim:

1. An ice skateboard comprising a skateboard having a top surface, a bottom surface, side edges, and a front and back section, said ice skateboard having an ice blade assembly consisting of a mounting plate having one integral ice blade with a flat edge that extends outwardly at substantially right angles from said mounting plate, where said mounting plate has a length which is the same as a length of said ice blade.

2. An ice skateboard as defined in claim 1 where the top surface of the ice skateboard had a surface which is a skid resistant surface.

3. An ice skateboard as defined in claim 1 wherein said mounting plate is bolted to said ice skateboard.

4. An ice skateboard as defined in claim 1 wherein said mounting plate is glued to said ice skateboard.

5. An ice skateboard as defined in claim 1 wherein a braking means is attached to the bottom of said ice skateboard which is actuated by lifting the front section of said ice skateboard and causing the braking, means to contact the ice.

* * * * *